US010557628B2

(12) United States Patent
Isayan

(10) Patent No.: US 10,557,628 B2
(45) Date of Patent: Feb. 11, 2020

(54) HANDHELD VAPORIZER

(71) Applicant: Sevak Isayan, Glendale, CA (US)

(72) Inventor: Sevak Isayan, Glendale, CA (US)

( * ) Notice: Subject to any disclaimer, the term of this patent is extended or adjusted under 35 U.S.C. 154(b) by 1042 days.

(21) Appl. No.: 14/936,589

(22) Filed: Nov. 9, 2015

(65) Prior Publication Data

US 2016/0131360 A1 May 12, 2016

Related U.S. Application Data

(60) Provisional application No. 62/077,798, filed on Nov. 10, 2014.

(51) Int. Cl.
*F22B 1/20* (2006.01)
*F22B 1/28* (2006.01)

(52) U.S. Cl.
CPC ..... *F22B 1/28* (2013.01)

(58) Field of Classification Search
CPC ..... F22B 1/28; F22B 1/284; A24F 47/008; A61M 15/0003; A61M 15/0021; A61M 15/0028; A61M 15/06; A61M 11/003; A61M 11/041; A61M 11/042; A61M 2205/8206; A61M 2206/14; H05B 3/0014; H05B 3/12; H05B 3/141; H05B 3/145; H05B 3/24; H05B 3/26; H05B 3/34; H05B 3/347; H05B 2203/015; H05B 2203/021; B32B 27/06; B32B 27/12; B32B 27/281; B32B 5/024; B32B 2250/02; B32B 2457/00; B32B 2307/202; B32B 2262/106
USPC ..... 219/211, 270; 131/273, 328, 329; 392/386, 391, 394, 395
See application file for complete search history.

(56) References Cited

U.S. PATENT DOCUMENTS 6,772,756 B2 * 8/2004 Shayan ..... A61M 11/041 392/386
2007/0280652 A1 * 12/2007 Williams ..... A24F 1/30 392/386
2010/0301032 A1 12/2010 Johnson
2012/0325229 A1 12/2012 Chang
2013/0298905 A1 * 11/2013 Levin ..... A24F 47/008 128/202.21
2014/0021190 A1 1/2014 Sardar
2014/0321837 A1 * 10/2014 Flick ..... F24H 1/0018 392/394
2015/0128976 A1 * 5/2015 Verleur ..... A24F 47/008 131/329

(Continued)

*Primary Examiner* — Hung D Nguyen
(74) *Attorney, Agent, or Firm* — Loza & Loza, LLP; Sevan Savsa

(57) ABSTRACT

One feature pertains to a handheld vaporization apparatus that includes a heating element and a housing that encases the heating element. The housing includes a first end having an opening that allows heated air provided by the heating element to exit out through the first end. The housing further includes one or more air ducts on an outer surface of the housing, where the one or more air ducts allow ambient air outside the housing to enter into the housing and flow past the heating element so as to be heated by the heating element. In one example, the housing's first end has a semi-ovoid shape that presses against and seals a hemi-spherical-shaped bowl. In another example, the housing's first end includes an elastic ring that surrounds the opening and presses against the inner surface of the bowl to create a substantially airtight seal.

17 Claims, 16 Drawing Sheets

(56) References Cited

U.S. PATENT DOCUMENTS

2015/0181935 A1* 7/2015 Lyubomirskiy ..... A24F 47/008
392/386

* cited by examiner

HANDHELD VAPORIZER

CLAIM OF PRIORITY

The present application for patent claims priority to provisional application No. 62/077,798 entitled "Herbal Vaporizer" filed Nov. 10, 2014, the entire disclosure of which is hereby expressly incorporated by reference.

BACKGROUND

Field

Various features generally relate to inhalation devices, and more specifically, to devices for extracting ingredients from a substance, such as a plant-based substance, through vaporization.

Background

The extraction of natural ingredients from substances such as plant-based substances (e.g., herbs, botanicals, tobacco, marijuana, tetrahydrocannabinol (THC) containing substances, etc.) has been found to have significant benefits both inside and outside the medical community. While one extraction method involves placing the product in a convenient form such as a pill to control the release rate and amount of the ingredients after ingestion, the benefits of directly inhaling the active ingredients into the circulatory system have desirable effects too. Such inhalation methods circumvent the drawbacks associated with first digesting the product to process it into the bloodstream.

For this and other reasons, one common way of extracting the ingredients from a substance through inhalation is simply obtained from smoking the substance by applying fire directly to it to burn the substance and inhale the desired ingredients as they are released. However, several disadvantages arise in light of inhaling undesirable particulate along with the desired ingredients. More specifically, smoke particles enter and irritate the user's throat and lungs and introduce additional hazards to the user's body. Prolonged smoking introduces significant health risks in the mouth, throat, lungs and heart of the user. In addition, applying fire directly to the substance burns up a significant amount of the quantity resulting in using more than necessary to acquire the desired dosage and or effect.

Several devices which have reached the commercial marketplace seek to avoid the concerns caused by smoking an herbal product such as tobacco and/or marijuana. These devices seek to overcome the drawbacks of smoking by removing the smoke and carcinogens from the inhalation process as well as the odor caused by the smoke by vaporizing the herbal product instead of burning it with flame applied directly to the product. Some of these commercially available devices are large, unwieldy vaporization devices that are strictly devoted for vaporization.

One such example includes a vapor collecting chamber or balloon surrounding or coupled to a plate upon which the desired quantity of an herb is placed. The plate is heated to vaporize the herbs until the chamber is filled with a desired quantity of vapor. The vapors collected in the chamber may be withdrawn by inhaling from a tube connected to a passage leading to the interior of the chamber. However, such a device is not easily portable, may be expensive, and can only be used for vaporization purposes. The hot plate may also take several minutes to reach a sufficient temperature for vaporization causing undesirable delay.

There is a need for an herbal vaporizer that is portable, lightweight, effective, fast, and may be used with a variety of existing pipes and water pipes that are conventionally used for smoking herbal products. Such an herbal vaporizer would allow the user to easily carry the vaporizer for use with their own or others' pipes and water pipes thereby obviating the need to invest in a large and cumbersome device strictly dedicated to vaporization.

SUMMARY

One feature provides a vaporization apparatus comprising a heating element and a housing encasing the heating element. The housing includes a first end having an opening adapted to allow heated air provided by the heating element to exit out through the first end. The housing further includes one or more air ducts on an outer surface of the housing, where the one or more air ducts are adapted to allow ambient air outside the housing to enter into the housing and flow past the heating element so as to be heated by the heating element. According to one aspect, the first end has a semi-ovoid shape. According to another aspect, the semi-ovoid shaped first end is adapted to press against and substantially seal a substantially hemispherical-shaped bowl.

According to one aspect, the first end includes an elastic ring that surrounds the opening and is adapted to press against and substantially seal a substantially hemispherical-shaped bowl. According to another aspect, the heating element is positioned in between the one or more air ducts and the first end. According to yet another aspect, the housing includes a second end opposite the first end, the second end including a Universal Serial Bus (USB) connector adapted to recharge a battery within the housing that provides power to the heating element.

According to one aspect, the second end includes a USB cover adapted to removeably couple to the second end of the housing and cover the USB connector. According to another aspect, the heating element is positioned between two (2) and twenty (20) millimeters away from the first end within the housing. According to yet another aspect, the heating element is adapted to achieve a temperature ranging from 250 to 2,000 degrees Fahrenheit.

According to one aspect, the heating element is adapted to achieve a temperature ranging from 330 to 500 degrees Fahrenheit. According to another aspect, the housing is substantially cylindrical-shaped. According to yet another aspect, the vaporization apparatus further comprises a battery within the housing that supplies power to the heating element, and a button coupled to the housing, the button adapted to activate the battery causing it to supply power to the heating element.

According to one aspect, the apparatus further comprises a fan positioned behind the heating element such that the fan is positioned between the heating element and at least one of the one or more air ducts, the fan adapted to draw the ambient air outside the housing through the one or more air ducts and blow the ambient air drawn across the heating element and out through the opening of the first end. According to another aspect, the apparatus further comprises a temperature sensor coupled to the heating element and adapted to sense the temperature of the heating element, a display coupled to the housing and adapted to show the temperature of the heating element sensed by the temperature sensor, and an input interface coupled to the housing and adapted to control the temperature of the heating element.

Another feature provides an apparatus comprising a heating element adapted to heat air, a housing encasing the heating element, the housing including a first end having an opening and at least one air flow hole, the heating element positioned between the opening and the air flow hole, and wherein a low air pressure region at the first end relative to ambient air outside of the air flow hole causes the ambient air to be drawn into the housing through the air flow hole and flow past the heating element and out through the opening at the first end. According to one aspect, the first end has a semi-ovoid shape that is adapted to press against an inner surface of a bowl. According to another aspect, the first end includes an elastic ring that surrounds the opening and is adapted to press against the inner surface of the bowl.

Another feature provides an apparatus comprising means for heating, an input interface adapted to activate the means for heating, and a housing at least partially enclosing the means for heating, the housing having a first end with a substantially semi-ovoid shape, the first end having an opening adapted to allow heat from the means for heating to radiate out from the first end. According to one aspect, the first end includes an elastic ring that surrounds the opening and is adapted to press against an inner surface of a bowl to create a substantially airtight seal. According to another aspect, the apparatus further comprises a chamber within the housing, and at least one air duct located on an outer surface of the housing that allows air to flow into the chamber through the air duct, and wherein the means for heating is positioned such that air flowing into the chamber from the air duct flows through the means for heating to be heated before it flows out through the opening.

BRIEF DESCRIPTION OF THE DRAWINGS

FIG. 2 illustrates a side view of the vaporizer with its USB cover on.

DETAILED DESCRIPTION

In the following description, specific details are given to provide a thorough understanding of the various aspects of the disclosure. However, it will be understood by one of ordinary skill in the art that the aspects may be practiced without these specific details. For example, circuits may be shown in block diagrams in order to avoid obscuring the aspects in unnecessary detail. In other instances, well-known circuits, structures and techniques may not be shown in detail in order not to obscure the aspects of the disclosure.

The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "herbal product" is used herein to mean any plant-based substance or substance that includes plant material.

Overview

A person desiring to vaporize an herbal product simply places the herbal product in any pipe, water pipe, or other device having a bowl configured to hold the herbal product in such a way as to expose at least a portion of the herbal product. The person then turns ON the vaporizer, applies a first end of the vaporizer closely to the exposed end of the bowl holding the herbal product, and inhales on the pipe. This causes ambient air to enter the vaporizer through its air ducts and come out the first end having been heated to such a degree as to vaporize the herbal product. The vapors from the herbal product enter the pipe and may be consumed/inhaled by the person.

Exemplary Vaporizers

Figure 1:
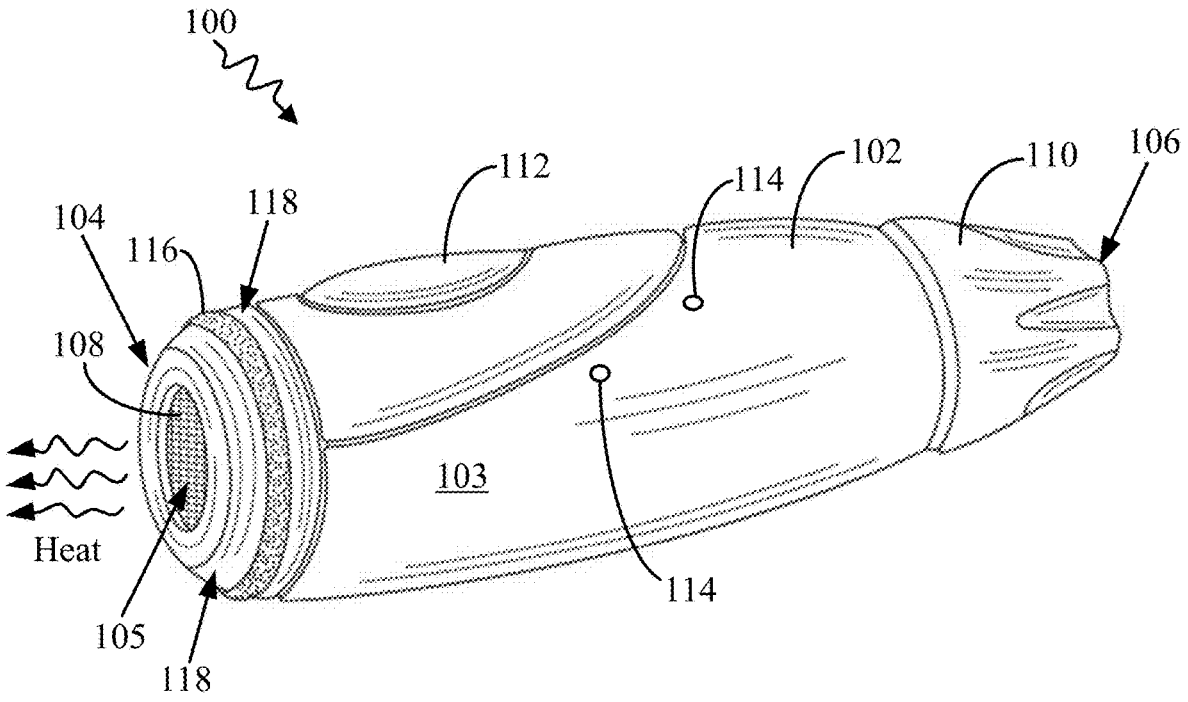
FIG. 1 illustrates a perspective view of a first exemplary handheld vaporization apparatus ("vaporizer").
Figure 2:
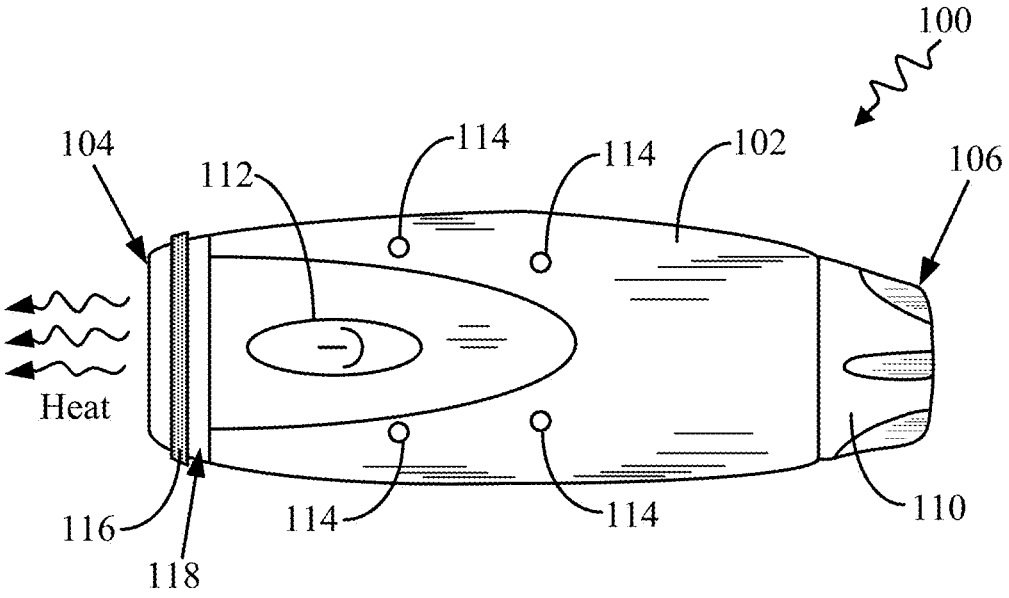
Figure 3:
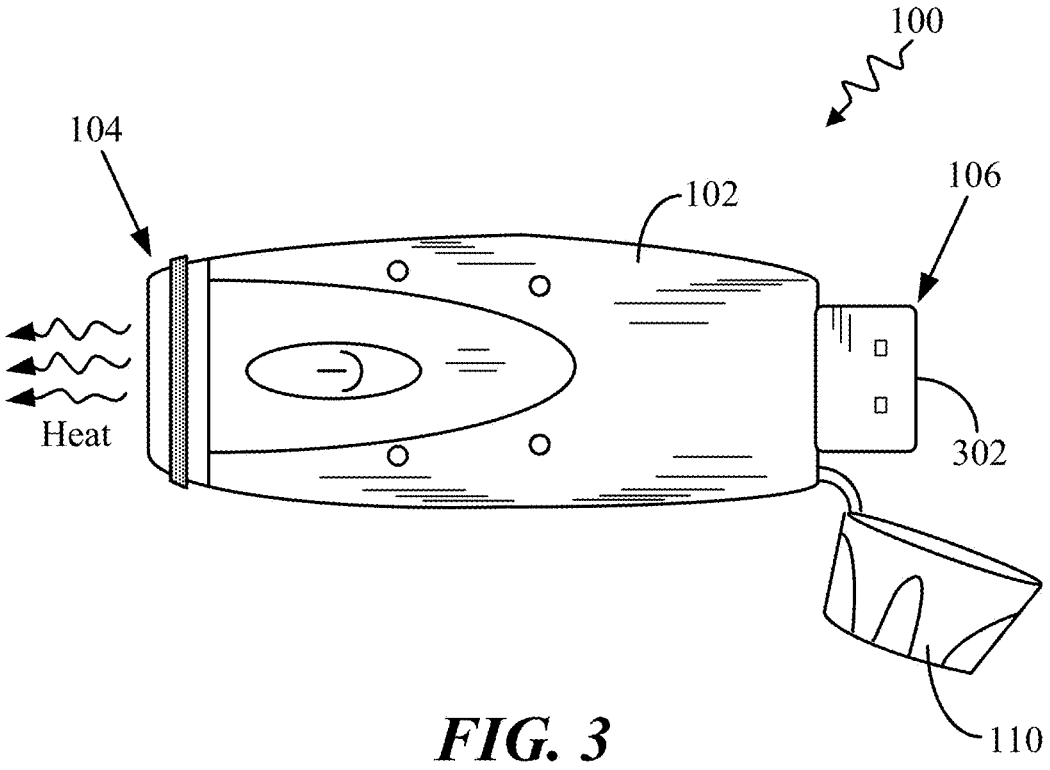
FIG. 3 illustrates a side view of the vaporizer with its USB cover uncoupled exposing the USB connector underneath.

FIGS. 1-3 illustrate various views of a handheld vaporization apparatus 100 (e.g., "vaporizer") according to one embodiment. More specifically, FIG. 1 illustrates a perspective view of the vaporizer 100, and FIGS. 2 and 3 illustrate side views of the vaporizer 100. The vaporizer 100 shown in FIG. 3 illustrates the vaporizer 100 with its Universal Serial Bus (USB) cover 110 (e.g., "USB cap") uncoupled/open exposing the USB connector 302 underneath.

Referring to FIGS. 1-3, the vaporizer 100 may include, among other things, a housing 102 (e.g., also may be referred to as a "casing"), a first end 104, a second end 106 opposite the first end 104, a mesh wire screen 108, a USB cover 110, a USB connector 302, an ON/OFF switch 112, and one or more air ducts 114 (e.g., "air flow holes"). The vaporizer 100 is designed to be relatively small and portable, and is sized and shaped to fit comfortably in the hand or pocket of a user.

The housing 102 securely contains and protects many of the internal components of the vaporizer 100 including but not limited to a heating element, power supply (e.g., battery), electronics, circuits, sensors, etc. The housing 102 may be composed of metal, ceramic, wood, plastic, and/or other materials that are sturdy and durable. In one embodiment, the housing 102 is composed of a material that has low thermal conductivity to minimize heat transfer from a heating element within the vaporizer 100 to the outer surface 103 of the housing 102 in order to prevent contact burns.

The first end 104 of the vaporizer 100 contains an opening 105 within which resides a heating element (discussed in greater detail below) that supplies heat for vaporization of herbal products. The first end 104 is configured to removeably couple to a bowl of a pipe or water pipe, such as a bong, hookah, etc. (not shown in FIG. 1), containing the herbal products. Once coupled to a bowl, heat generated at the heating element and emanating out from the opening 105 at the first end 104 causes the herbal products within the bowl to vaporize, which can then be inhaled by the user.

As shown in the illustrated example, in one embodiment the first end 104 may have a curved shape similar to a bottom of an egg. That is, the first end 104 may have a semi-ovoid shape. This curved, semi-ovoid shape helps the first end 104 snugly fit within and couple to bowls of various sizes. The first end 104 may also include an elastic ring 116 (e.g., "gasket") on the curved, outer surface 118 of the first end 104. As will be explained in greater detail below, the elastic ring 116, which may be composed of rubber, silicone, and/or plastic, helps create an airtight seal between the inside of the pipe's bowl where the herbal product resides and outside the bowl. The elastic ring 116 protrudes slightly above the first end's curved, outer surface 118 so that it may make contact with the inside of the bowl before the outer surface 118 does. Thus, the elastic ring 116 may be raised slightly with respect to the curved, outer surface 118 of the first end 104.

According to one example, the first end's opening 105 may be covered by a mesh wire screen 108 to prevent a user of the vaporizer 100 from accidentally touching or coming too close to the heating element within, thereby protecting the user from burns. The screen 108 also prevents debris and other objects from entering the opening 105 and possibly damaging components inside the vaporizer 100.

In one embodiment, the second end 106 of the vaporizer 100 may include a USB connector 302 (or any other type of connector not limited to USB) for charging a battery within the vaporizer 100. The battery (not shown in FIG. 1) supplies power to the heating element and other electronics. To protect the USB connector 302 when it is not being used, the vaporizer may include a cover 110 that removeably couples to the second end 106 of the vaporizer 100 thereby shielding the USB connector 302. In other embodiments, the second end may not include the USB connector 302 or cover 110.

The ON/OFF switch 112 activates and deactivates (i.e., turns ON and OFF) the vaporizer's heating element. The air ducts 114 in the housing 102 allow air from outside the vaporizer 100 to flow into the vaporizer 100. As explained in greater detail below, the air flowing into the vaporizer 100 through the air ducts 114 is heated by the heating element before flowing out through the vaporizer's first end 104.

Figure 4:
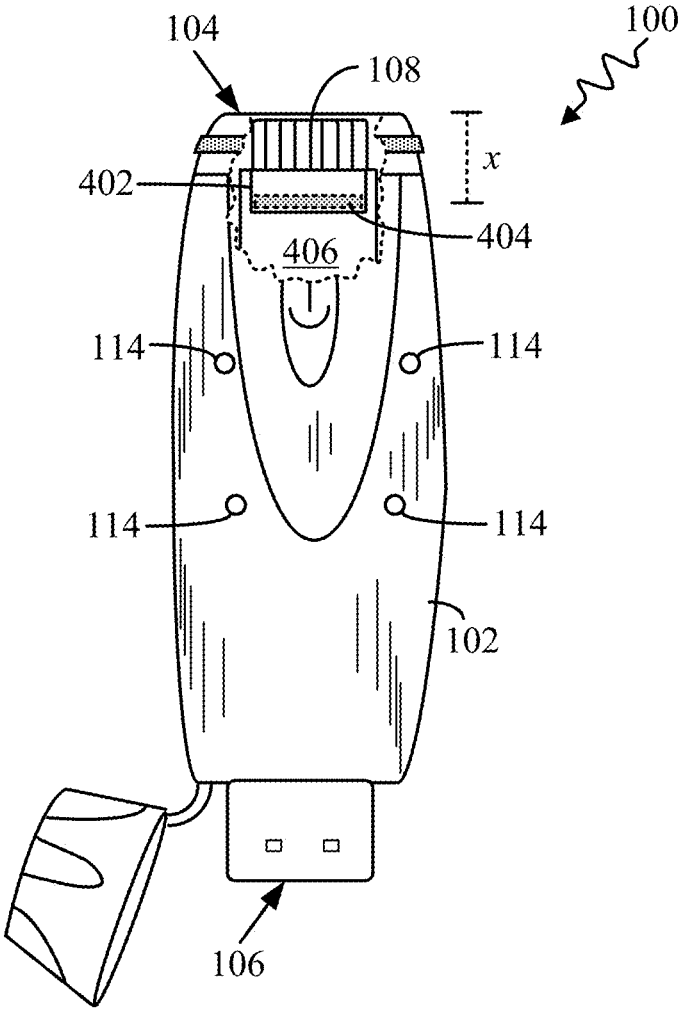
FIG. 4 illustrates a cutaway, side view of the vaporizer.

FIG. 4 illustrates a cutaway, side view of the vaporizer 100 according to one embodiment. The vaporizer 100 may include a heating element housing 402 that contains and secures the heating element 404. (The dashed lines of the heating element 404 indicate that its contained within the heating element housing 402.) The heating element housing 402 may be made of porcelain, ceramic, and/or metal.

The heating element 404 may include a resistance wire heating element wrapped around in a coil. The resistance wire may be, for example, composed of nichrome (80% nickel and 20% chromium) or some other metal alloy such as but not limited to an iron-chromium-aluminum alloy. Electric current supplied by a battery (not shown in FIG. 4) internal to the vaporizer 100 passes through the heating element 404 and because of the heating element's 404 resistance, the heating element 404 heats up. The heating element 404 may be configured to achieve and maintain temperatures ranging from 200 degrees to 2,000 degrees Fahrenheit. In one embodiment, the heating element 404 heats up to temperatures so that just outside the first end 104 of the vaporizer 100 (i.e., just past the wire mesh screen 108) the temperature ranges between 300 degrees and 500 degrees Fahrenheit. This way popular herbal products, such as marijuana, placed close to the first end 104 vaporize but do not burn.

In one embodiment, the heating element 404 is located a distance x millimeters (mm) away from the first end 104 where x may range between 1 mm and 20 mm. In some aspects, the heating element 404 may be positioned about 5 to 10 mm away from the first end 104 (i.e., 5 mm≤x≤10 mm). The distance away from the first end 104 the heating element 404 is positioned may be dictated by the temperature desired to be achieved at or about the first end 104 where herbal products will be placed. For example, if higher temperatures are desired at the first end 104 the heating element 404 may be positioned closer to the first end 104 (i.e., x is minimized). By contrast, if lower temperatures are desired at the first end 104 the heating element 404 may be positioned further away from the first end 104 (i.e., x is maximized).

According to one embodiment, the air ducts 114 are positioned below the heating element 404 on the outer surface 103 of the housing as shown. That is, the heating element 404 is positioned in between the air ducts 114 and the first end 104. The air ducts 114 allow ambient air from outside the vaporizer 100 to enter into the housing 102 just below the heating element 404. In one aspect, the ambient air enters into a chamber 406 within the housing 102 that contains the heating element housing 402 and heating element 404. This air is then heated as it flows past the heating element 404 and out through the first end's opening 105. The vaporizer 100 may have any number (e.g., 1, 2, 3, 4, 5, 6, etc.) of air ducts 114 and the chamber 406 may be cylindrically shaped.

Figure 5:
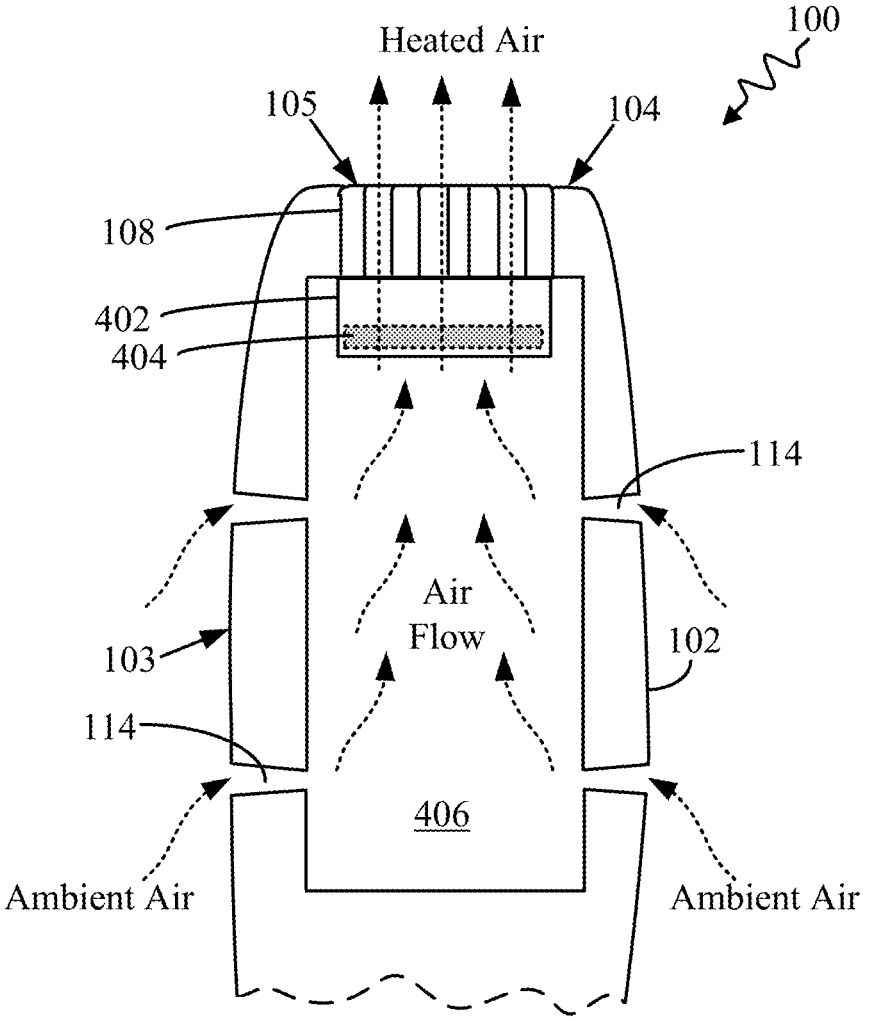
FIG. 5 illustrates a schematic drawing of the operation of the vaporizer.

FIG. 5 illustrates a schematic drawing of the operation of the vaporizer 100 according to just one embodiment. Ambient air from outside the vaporizer 100 enters into the housing 102 and/or the chamber 406 within the housing 102 as shown. Once the air enters the chamber 406 and/or the housing 102, it flows through/past the heating element 404, which if turned ON, heats the air as it passes by. The heated air then exits out though the opening 105 of the first end 104 and may be used to vaporize herbal products that are positioned at or near the first end 104 of the vaporizer 100.

There may be different mechanisms that cause the ambient air to enter into the chamber 406 and/or the housing 102 through the air ducts 114. In one embodiment, a low air pressure region relative to the ambient air is formed at the first end 104 caused by a user inhaling on a smoking apparatus (e.g., pipe, water pipe, hookah, etc.) having a bowl that is coupled to the first end 104 of the vaporizer 100. The low pressure region at the vaporizer's first end 104 causes higher pressure ambient air outside the vaporizer housing 102 to enter the chamber 406 and/or housing 102 through the air ducts 114.

Figure 6:
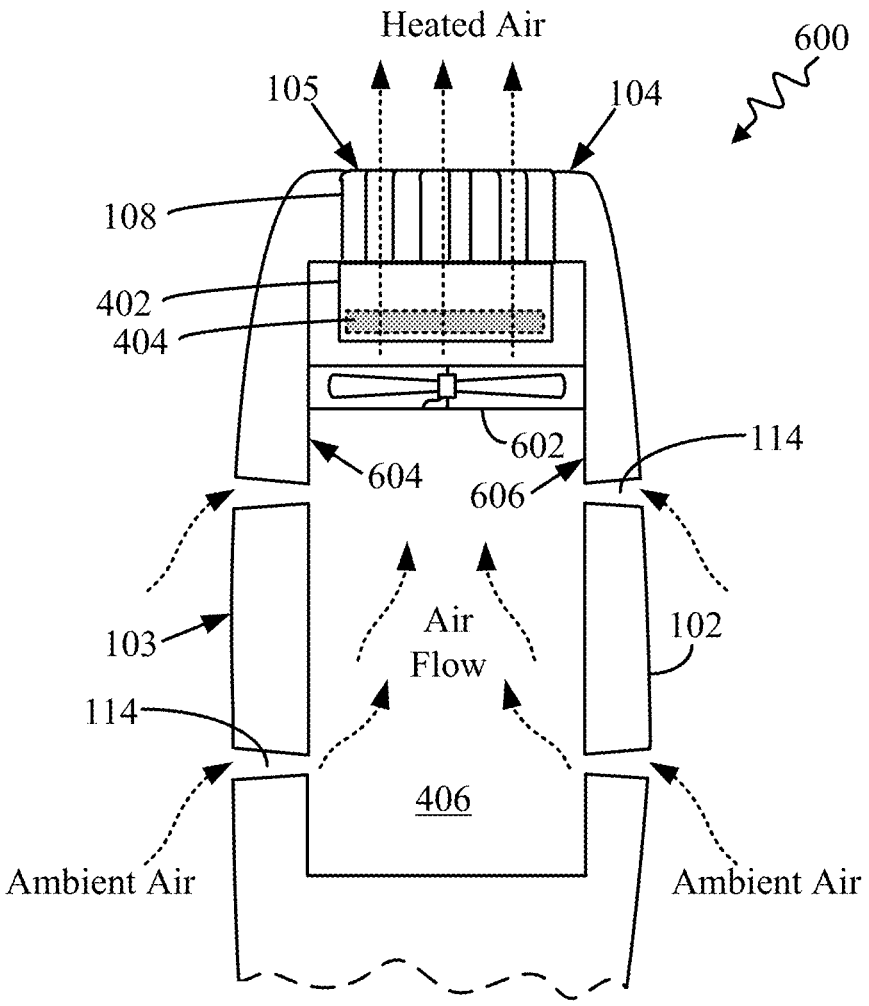
FIG. 6 illustrates a second exemplary vaporizer featuring a fan positioned behind the heating element.

Referring to FIG. 6, in another embodiment of the vaporizer 600, a fan 602 is positioned behind the heating element 404. When turned ON, the fan 602 forces air to be drawn in through the air ducts 114, and blown past the heating element 404 on its way out through the first end's opening 105. The fan 602 may be turned ON at about the same time or a little after the heating element 404 is activated. In one aspect, the fan 602 may substantially extend from one side 604 of the chamber 406 to the other side 606 (i.e., extends across the diameter of the chamber 406).

Figure 7:
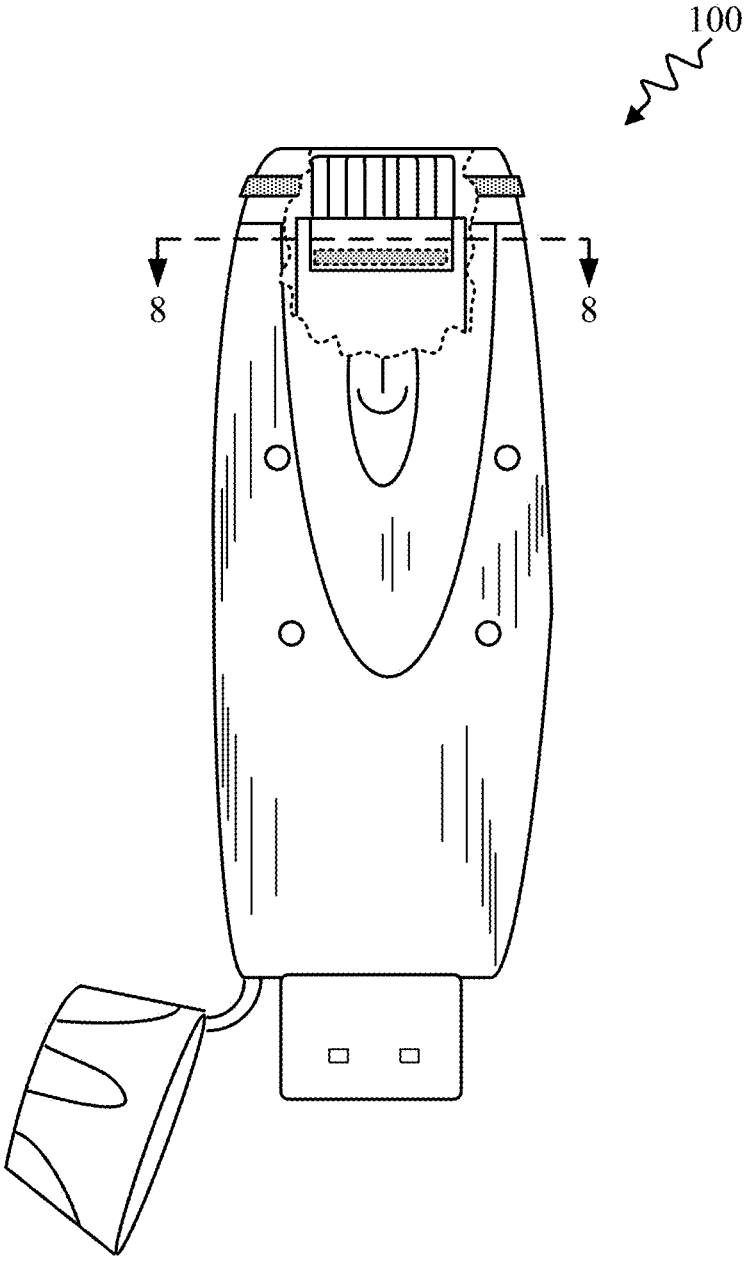
FIG. 7 illustrates a cutaway, side view of the vaporizer.

FIG. 7 illustrates a cutaway, side view of the vaporizer 100 according to one embodiment.

Figure 8:
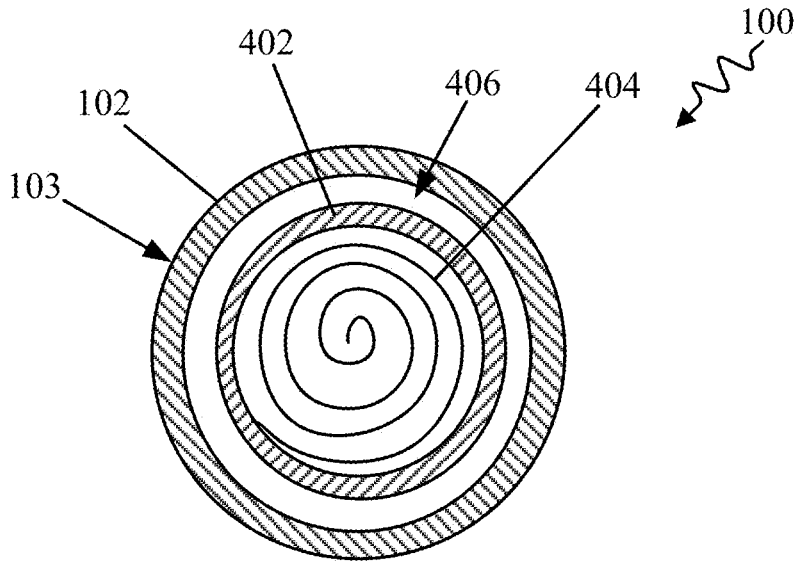
FIG. 8 illustrates a cross-sectional view of the vaporizer.

FIG. 8 illustrates a cross-sectional view of the vaporizer 100 about the line 8-8 of FIG. 7. In the illustrated example, the heating element 404 may be shaped like a coil and may reside within the heating element housing 402.

Figure 9:
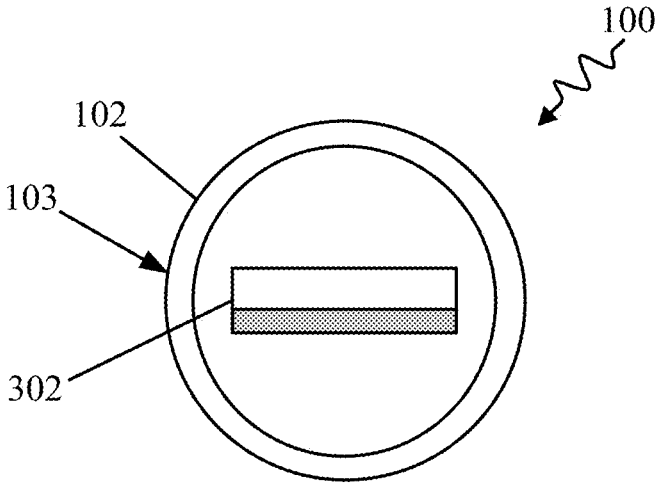
FIG. 9 illustrates a bottom view of a second end of the vaporizer with the USB cover removed.

FIG. 9 illustrates a bottom view of the second end 106 of the vaporizer 100 with the cover 110 removed according to one embodiment.

Figure 10:
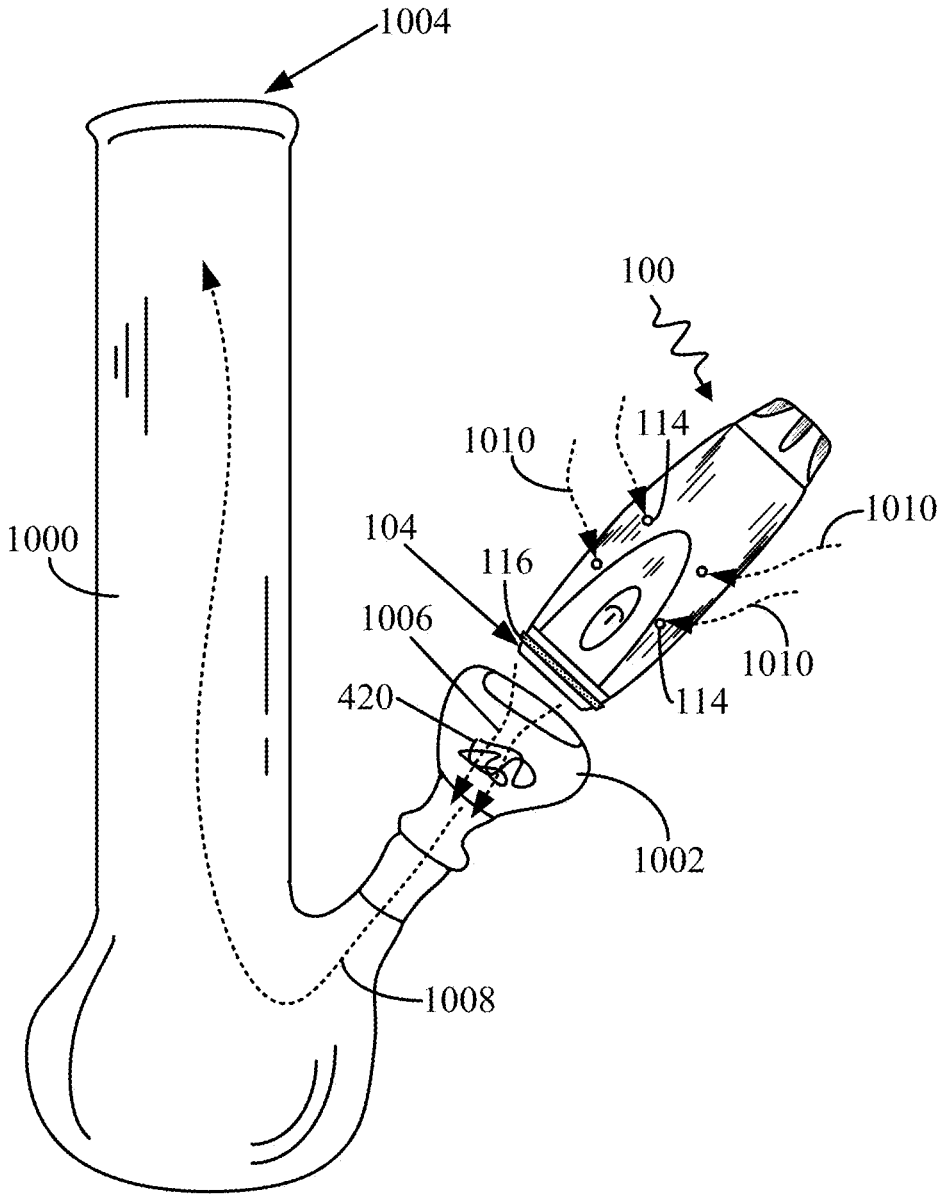
FIG. 10 illustrates the vaporizer in operation just before being coupled to a pipe's bowl.
Figure 11:
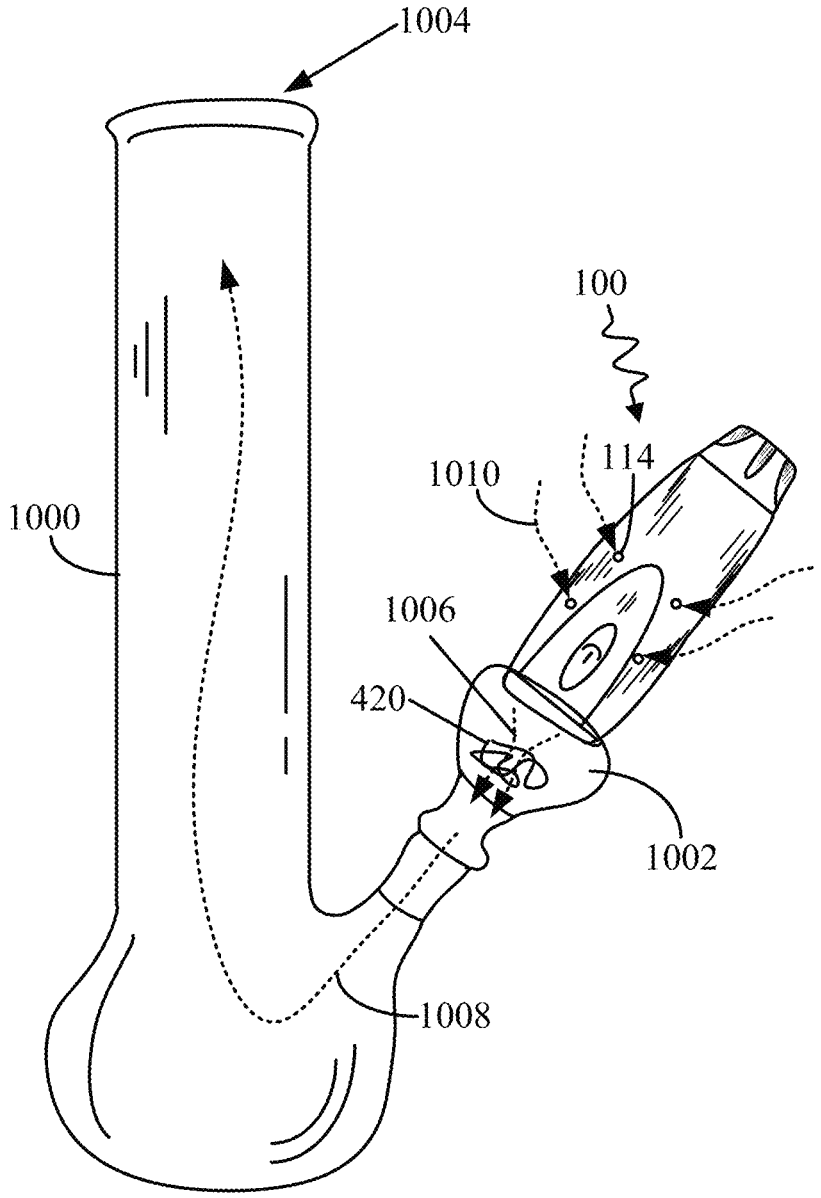
FIG. 11 illustrates the vaporizer in operation after it has been coupled to the bowl.

FIGS. 10 and 11 illustrate operation of the vaporizer 100 when used with, for example, a water pipe 1000. Specifically, FIG. 10 shows the vaporizer 100 just before being coupled to the pipe's bowl 1002, and FIG. 11 shows the vaporizer 100 coupled to the bowl 1002. The bowl 1002 has a substantially hemispherical shape where the herbal product 420 rests exposed within the bowl 804. A user wishing to utilize the vaporizer 100 may first fill the bowl 1002 with the herbal product 420. Next, the vaporizer 100 may be brought towards the bowl 1002 such that the vaporizer's first end 104 couples to the inside of the bowl 1002. As explained in greater detail below, the elastic ring 116 may help create an airtight seal between the bowl 1002 and the vaporizer 100.

After coupling the vaporizer's first end 104 to the bowl 1002, the vaporizer 100 may be switched ON using the ON/OFF switch 112. When the heating element 404 has heated up to the desired vaporization temperature, the user may inhale on the inhalation end 1004 of the pipe 1000. Inhaling causes a low pressure region to build up within the pipe 1000 and the bowl 1002. This causes heated air 1006 to be drawn into the bowl 1002 from the opening 105 (see FIG. 1) at the vaporizer's first end 104. Maintaining a good seal between the vaporizer's first end 104 and the bowl 1002 is important so that the air drawn into the bowl 1002 is heated air from the vaporizer 100 and not ambient air found just outside of the bowl 1002. The elastic ring 116 helps form that airtight seal. The heated air 1006 is capable of vaporizing the herbal product 420 within the bowl 1002 into a vapor 1008 that can then be consumed by the user.

The heated air 1006 drawn out from the first end 104 of the vaporizer 100 is supplied by ambient air 1010 flowing into the vaporizer's air ducts 114. As described above, this ambient air 1010 is heated as it flows past the heating element 404 (see FIGS. 4 and 5) within the vaporizer 100. In the example shown in FIG. 10, a water pipe 1000 is used to demonstrate operation of the vaporizer 100. However, the vaporizer 100 may be used in conjunction with any other pipe or device that includes an open bowl design configured to hold an herbal product.

Figure 12:
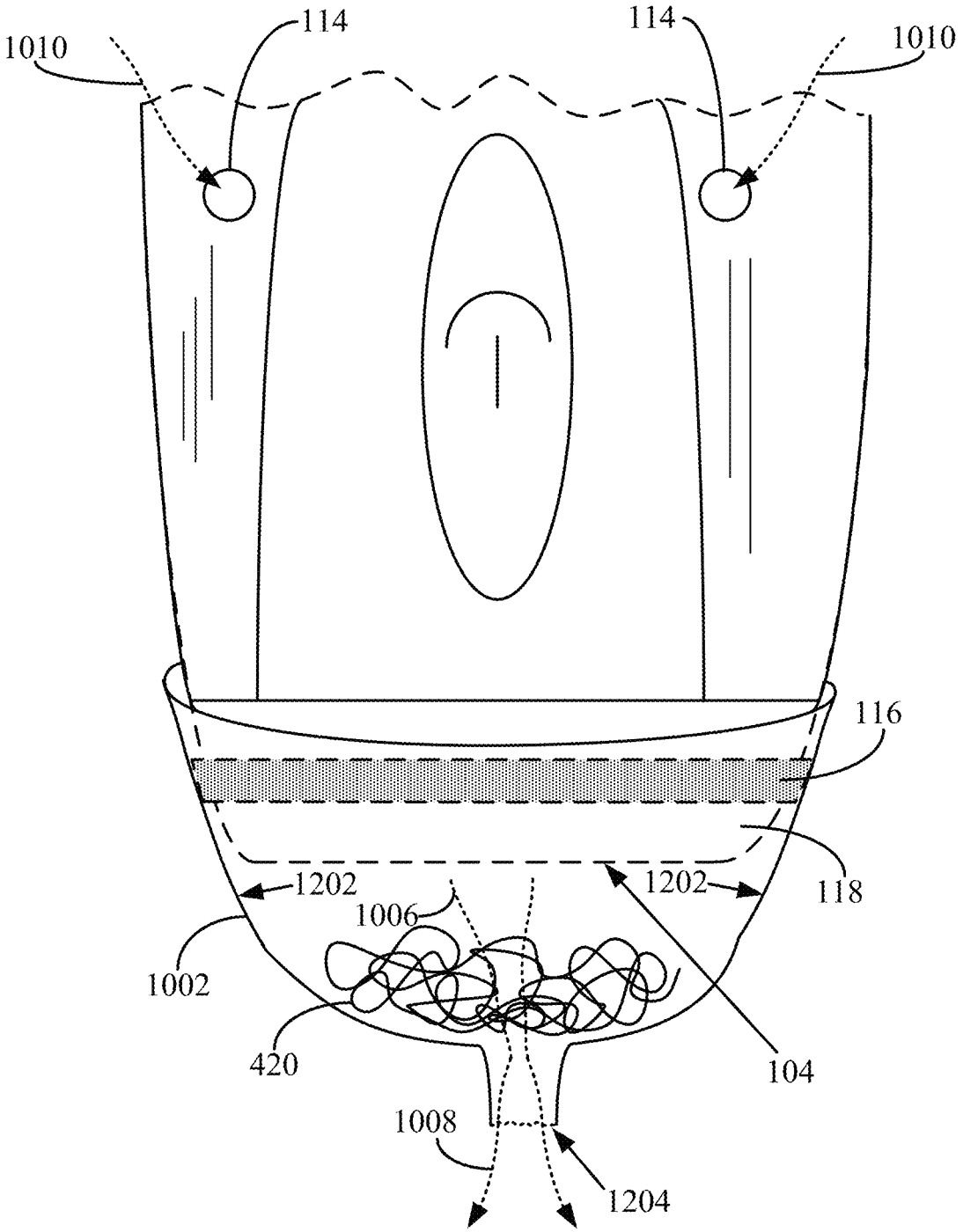
FIG. 12 illustrates a close-up view of the vaporizer's first end coupling to a bowl.

FIG. 12 illustrates a close-up view of the vaporizer's first end 104 coupling to a bowl 1002 according to one embodiment. First end 104 may be placed on top or within the bowl 1002 so that the elastic ring 116 touches the inner sidewalls 1202 of the bowl 1002. Ideally, the elastic ring 116 touches the entire circumference of the inner sidewalls 1202 of the bowl 1002 so that a substantially airtight seal is formed between the vaporizer 100 and the bowl 1002. In one example, the elastic ring 116 is made of an elastic material, such as rubber, silicone, and/or plastic, so that it deforms slightly to fill in any crevices and irregularities of the bowl's inner sidewalls 1202. The semi-ovoid shape of the vaporizer's first end 104 and the elastic ring 116 help the vaporizer 100 to work with bowls of various sizes and ensure an airtight seal in most cases.

As described above, ambient air 1010 enters the vaporizer's air ducts 114 and is heated by the heating element 404 (see FIGS. 4 and 5) within the vaporizer 100. The heated air 1006 then exits out of the vaporizer's first end 104 and heats the herbal product 420 so that it vaporizes. The resulting vapor 1008 then flows out from a bottom opening 1204 of the bowl 1002 and is eventually inhaled by the user.

Figure 13:
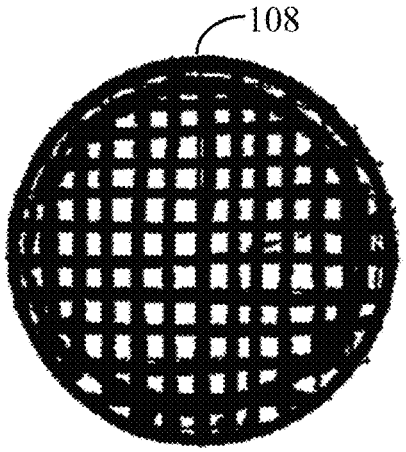
FIG. 13 illustrates a top view of the wire mesh screen.

FIG. 13 illustrates a top view of the wire mesh screen 108 according to one embodiment.

Figure 14:
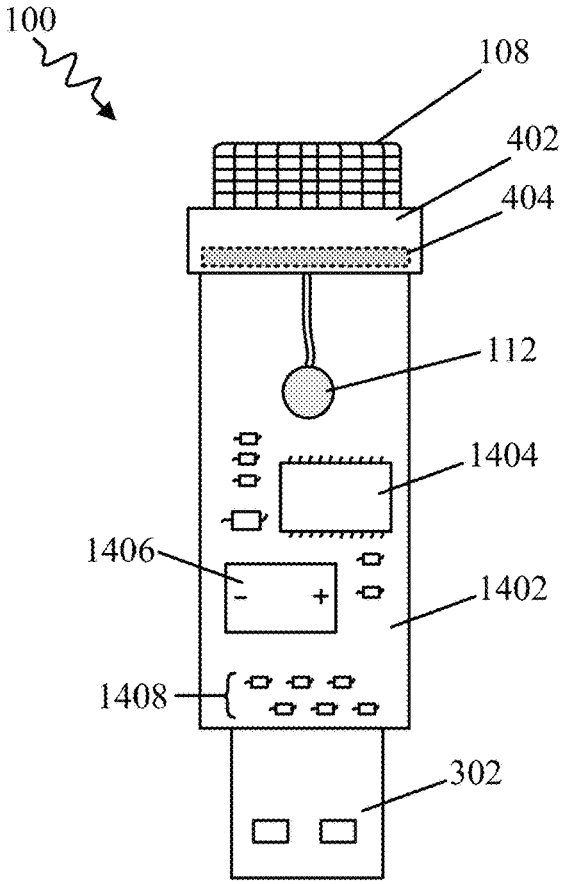
FIG. 14 illustrates a side view of the vaporizer with the housing removed showing the electrical components inside.

FIG. 14 illustrates a side view of the vaporizer 100 with the housing 102 removed according to one embodiment. The vaporizer 100 may further include a circuit board 1402 that contains a plurality of circuit components such as but not limited to an IC microcontroller(s) 1404 and a battery 1406. The IC microcontroller(s) 1404 may help activate and regulate the heating element 404. For example, the IC microcontroller(s) 1404 may ensure that the temperature of the heating element 404 stays within a predetermined range. The battery 1406 supplies the electrical power necessary to operate the heating element 404 and other electrical components of the vaporizer 100. The battery 1406 may be a rechargeable battery capable of being recharged using the USB connector 302. The circuit board 1402 may also include one or more light emitting diodes (LEDs) and/or a digital display (e.g., liquid crystal display) that signal various messages to a user of the vaporizer 100. Such messages may include but are not limited to: heating element 204 is ON and/or hot; the battery 1406 is low and needs to be recharged/replaced; the temperature of the heating element; and/or error messages.

Figure 15:
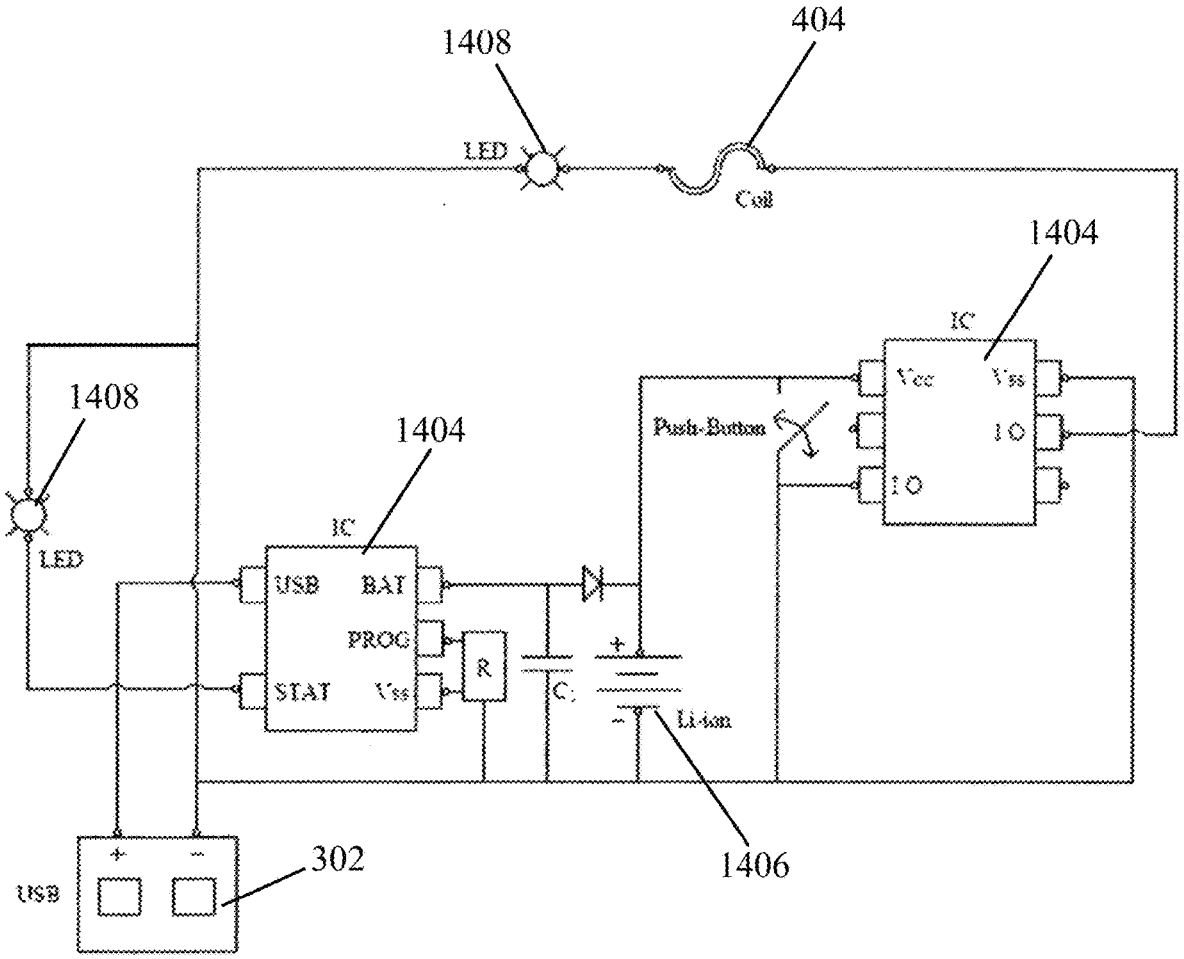
FIG. 15 illustrates an exemplary electrical schematic of the vaporizer.

FIG. 15 illustrates an exemplary electrical schematic depicting the vaporizer 100 according to one embodiment.

Figure 16:
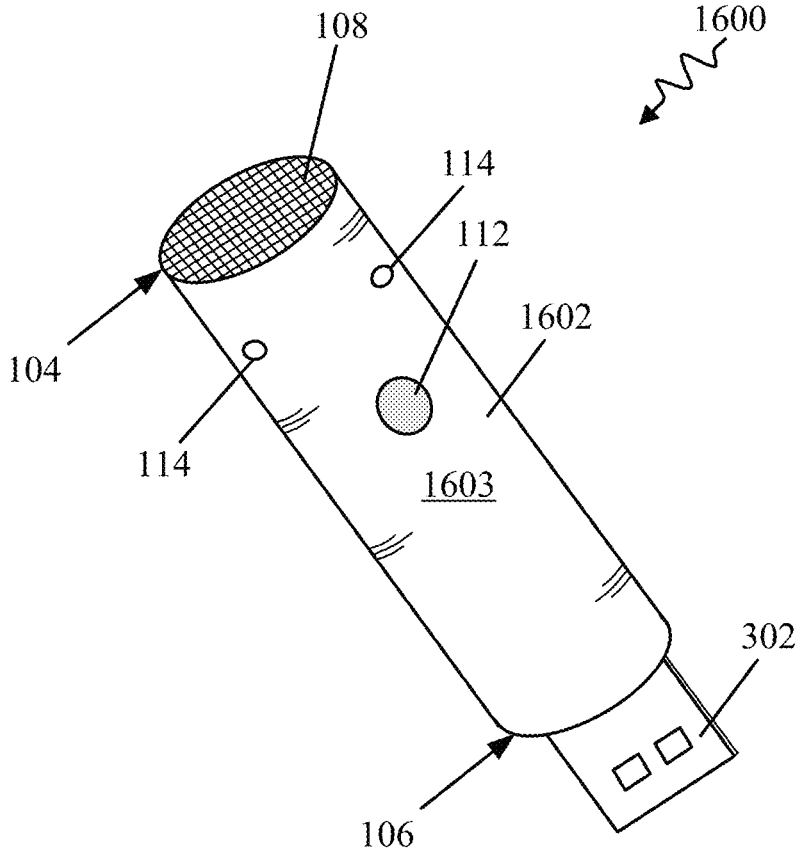
FIG. 16 illustrates a perspective view of a third exemplary vaporizer.
Figure 17:
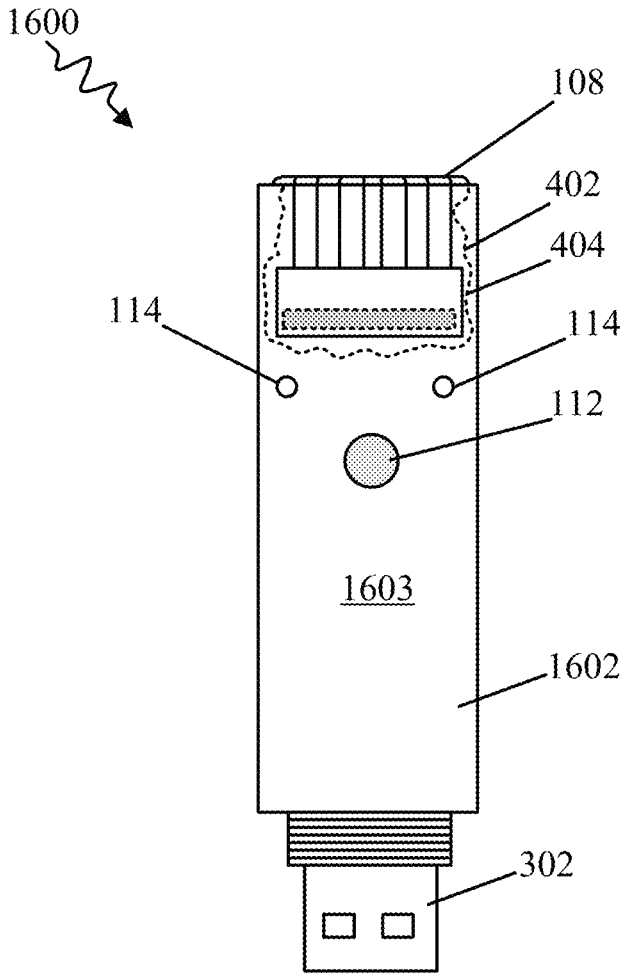
FIG. 17 illustrates a cut-away, side view of the third exemplary vaporizer revealing the heating element underneath the housing.
Figure 18:
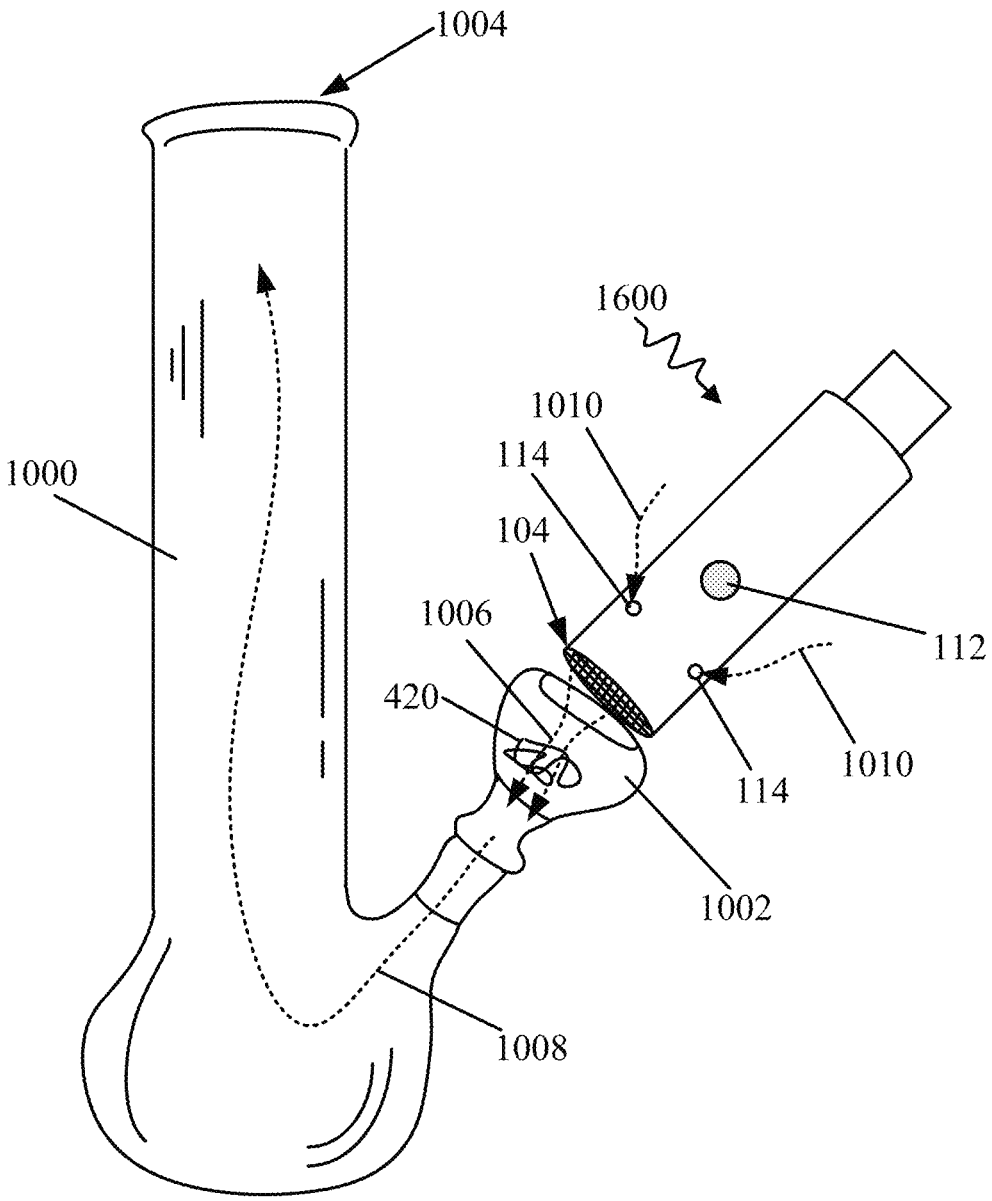
FIG. 18 illustrates the third exemplary vaporizer during operation.

FIGS. 16-18 illustrate a vaporization apparatus 1600 according to another embodiment. The vaporizer 1600 shown in FIGS. 16-18 is substantially the same as the vaporizer 100 described above except that it does not have a semi-ovoid shaped first end 104 nor an elastic ring 116 (see FIG. 1). Referring to FIG. 16, a perspective view of the vaporizer 1600 is shown. The vaporizer 1600 has a substantially cylindrical shaped housing 1602 with an outer surface 1603. Referring to FIG. 17, a cut-away side view of the vaporizer 1600 is shown revealing the heating element 404 underneath the housing 1602. FIG. 18 illustrates the vaporizer 1600 during operation. The user brings the first end 104 of the vaporizer 100 as close to the bowl 1002 as possible to maximize heat transfer.

Figure 19:
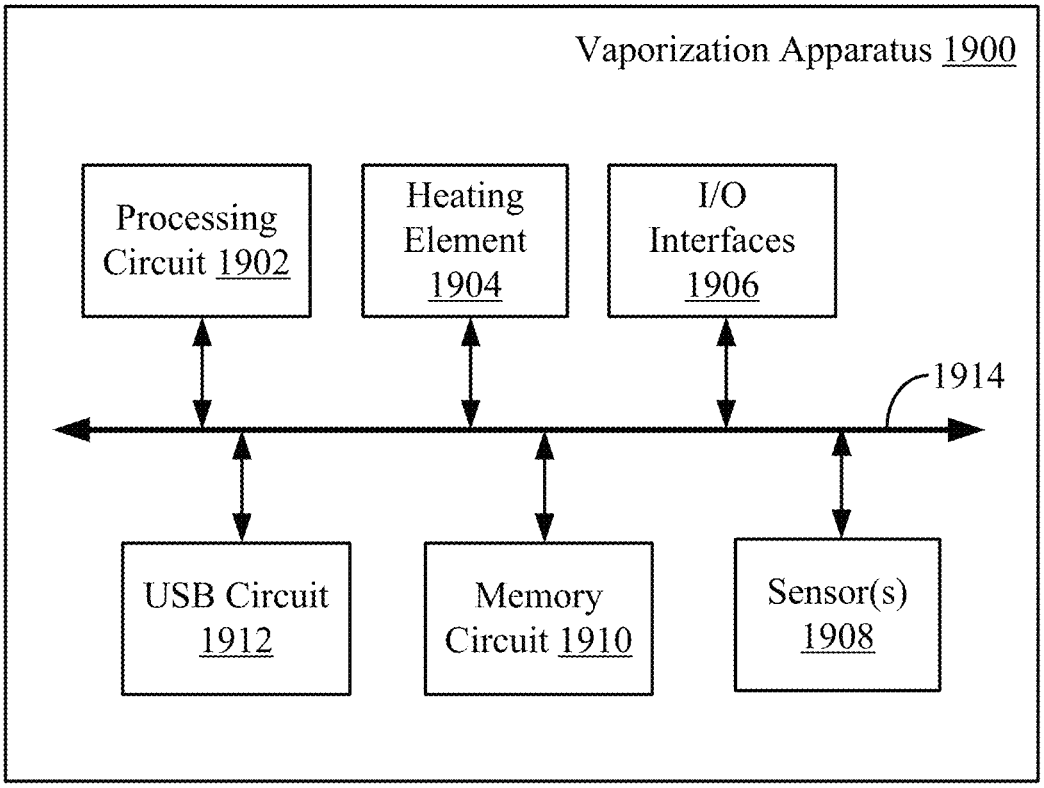
FIG. 19 illustrates a schematic block diagram of a vaporization apparatus.

FIG. 19 illustrates a schematic block diagram of a vaporization apparatus 1900 according to one aspect of the disclosure. The schematic block diagram shown in FIG. 19 may be associated with any one of the vaporizers 100, 600, 1600 described herein. The vaporization apparatus 1900 may include, among other things, a processing circuit 1902, a heating element 1904, input/output (I/O) interfaces 1906, sensors 1908, a memory circuit 1910, and a USB circuit 1912. These components may be communicatively coupled to each other through a bus 1914 and/or be directly coupled to one another.

The processing circuit 1902 may execute instructions stored in the memory circuit 1910. For example, the processing circuit 1902 may control functionality of the heating element 1904, various I/O interfaces 1906, sensors 1908, and the USB circuit 1912. Activation of the heating element 1904 may be regulated by the processing circuit 1902, which may receive heating element temperature information from a temperature sensor 1908 coupled to the heating element 1904. The I/O interfaces 1906 may include digital displays and/or LEDs that convey information pertaining to the temperature, battery life, and status of the vaporization apparatus 1900. The I/O interfaces 1906 may also include one or more buttons or dials that turn the vaporization apparatus ON or OFF and/or set the heating element's temperature. The USB circuit 1912 allows an internal rechargeable battery to be charged through a USB connector.

One or more of the components, steps, features, and/or functions illustrated in FIGS. 1, 2, 3, 4, 5, 6, 7, 8, 9, 10, 11, 12, 13, 14, 15, 16, 17, 18, and/or 19 may be rearranged and/or combined into a single component, step, feature or function or embodied in several components, steps, or functions. Additional elements, components, steps, and/or functions may also be added without departing from the invention.

The various features of the invention described herein can be implemented in different systems without departing from the invention. It should be noted that the foregoing aspects of the disclosure are merely examples and are not to be construed as limiting the invention. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

What is claimed is:

1. A vaporization apparatus comprising:

a heating element; and a housing encasing the heating element, the housing including a first end having an opening adapted to allow heated air provided by the heating element to exit out through the first end, the housing further including one or more air ducts on an outer surface of the housing, the one or more air ducts adapted to allow ambient air outside the housing to enter into the housing and flow past the heating element so as to be heated by the heating element, wherein the first end has a semi-ovoid shape that enables the first end to press against and substantially seal a substantially hemispherical-shaped bowl, and wherein the heated air enables vaporization of one or more herbal products contained in the substantially hemispherical-shaped bowl.

2. The vaporization apparatus of claim 1, wherein the first end includes an elastic ring that surrounds the opening and is adapted to press against and substantially seal the substantially hemispherical-shaped bowl.

3. The vaporization apparatus of claim 1, wherein the heating element is positioned in between the one or more air ducts and the first end.

4. The vaporization apparatus of claim 1, wherein the housing includes a second end opposite the first end, the second end including a Universal Serial Bus (USB) connector adapted to recharge a battery within the housing that provides power to the heating element.

5. The vaporization apparatus of claim 4, wherein the second end includes a USB cover adapted to removeably couple to the second end of the housing and cover the USB connector.

6. The vaporization apparatus of claim 1, wherein the heating element is positioned between two (2) and twenty (20) millimeters away from the first end within the housing.

7. The vaporization apparatus of claim 1, wherein the heating element is adapted to achieve a temperature ranging from 250 to 2,000 degrees Fahrenheit.

8. The vaporization apparatus of claim 7, wherein the heating element is adapted to achieve a temperature ranging from 330 to 500 degrees Fahrenheit.

9. The vaporization apparatus of claim 1, wherein the housing is substantially cylindrical-shaped.

10. The vaporization apparatus of claim 1, further comprising:

a battery within the housing that supplies power to the heating element; and a button coupled to the housing, the button adapted to activate the battery causing it to supply power to the heating element.

11. The vaporization apparatus of claim 1, further comprising:

a fan positioned behind the heating element such that the fan is positioned between the heating element and at least one of the one or more air ducts, the fan adapted to draw the ambient air outside the housing through the one or more air ducts and blow the ambient air drawn across the heating element and out through the opening of the first end.

12. The vaporization apparatus of claim 1, further comprising:

a temperature sensor coupled to the heating element and adapted to sense the temperature of the heating element;

a display coupled to the housing and adapted to show the temperature of the heating element sensed by the temperature sensor; and an input interface coupled to the housing and adapted to control the temperature of the heating element.

13. An apparatus comprising:

a heating element adapted to heat air; and a housing encasing the heating element, the housing including a first end having an opening and at least one air flow hole, the heating element positioned between the opening and the air flow hole, and wherein a low air pressure region at the first end relative to ambient air outside of the air flow hole causes the ambient air to be drawn into the housing through the air flow hole and flow past the heating element to provide heated air out through the opening at the first end, wherein the first end has a semi-ovoid shape that enables the first end to press against an inner surface of a substantially hemispherical-shaped bowl to substantially seal the substantially hemispherical-shaped bowl, and wherein the heated air enables vaporization of one or more herbal products contained in the substantially hemispherical-shaped bowl.

14. The apparatus of claim 13, wherein the first end includes an elastic ring that surrounds the opening and is adapted to press against the inner surface of the substantially hemispherical-shaped bowl.

15. An apparatus comprising:

means for heating;

an input interface adapted to activate the means for heating; and a housing at least partially enclosing the means for heating, the housing having a first end with a substantially semi-ovoid shape that enables the first end to press against an inner surface of a substantially hemispherical-shaped bowl to substantially seal the substantially hemispherical-shaped bowl, the first end having an opening adapted to allow heat from the means for heating to radiate out from the first end to vaporize one or more herbal products contained in the substantially hemispherical-shaped bowl.

16. The apparatus of claim 15, wherein the first end includes an elastic ring that surrounds the opening and is adapted to press against the inner surface of the substantially hemispherical-shaped bowl to create a substantially airtight seal.

17. The apparatus of claim 16, further comprising:

a chamber within the housing; and at least one air duct located on an outer surface of the housing that allows air to flow into the chamber through the air duct, and wherein the means for heating is positioned such that air flowing into the chamber from the air duct flows through the means for heating to be heated before it flows out through the opening.

* * * * *